United States Patent [19]

Burns

[11] Patent Number: 4,501,596

[45] Date of Patent: Feb. 26, 1985

[54] MOTOR FUEL

[75] Inventor: Lyle D. Burns, Bartlesville, Okla.

[73] Assignee: Phillips Petroleum Company, Bartlesville, Okla.

[21] Appl. No.: 566,463

[22] Filed: Dec. 28, 1983

[51] Int. Cl.[3] ..... C10L 1/22
[52] U.S. Cl. ..... 44/63; 252/386
[58] Field of Search ..... 44/63; 252/386; 548/239, 235, 238

[56] References Cited

U.S. PATENT DOCUMENTS

| | | | |
|---|---|---|---|
| 3,033,661 | 5/1962 | De Gray | 44/63 |
| 3,033,663 | 5/1962 | De Gray | 44/63 |
| 3,148,193 | 9/1964 | Gilbert | 44/63 |
| 4,195,976 | 4/1980 | Ryer et al. | 44/63 |

OTHER PUBLICATIONS 1982-1983, Aldrich Chemical Co., p. 809.

*Primary Examiner*—Y. Harris-Smith

[57] ABSTRACT

Oxazolines, oxazoles and their derivatives blend into gasoline at high octane value.

9 Claims, No Drawings

MOTOR FUEL

The invention relates to a normally liquid motor fuel. In one aspect, the invention relates to a gasoline additive. In another aspect, the invention relates to a method for improving the antiknock property of a gasoline composition.

Various antiknock agents have been suggested and employed for use in liquid fuel, particularly for predominantly hydrocarbon fuels to be employed in internal combustion engines. In such engines, it is highly desirable that the combustion of the fuel occurs at a relatively high compression ratio. Engines combusting the fuel at a high compression ratio require fuel having a relatively high octane number to insure knock free operation. None of the various known antiknock additives have proved to be entirely satisfactory. One widely used antiknock additive is tetraethyl lead and its use is being curtailed because of environmental concerns. The phaseout of leaded gasoline has added impetus to the search for a satisfactory substitute. The present invention is directed to a class of ashless (nonmetallic) substitutes for tetraethyl lead.

OBJECTS OF THE INVENTION

It is an object of this invention to provide a predominantly hydrocarbon fuel composition.

It is another object of this invention to provide an ashless antiknock additive for use in internal combustion engine fuels.

It is a further object of this invention to provide a method for improving the antiknock properties of a predominantly hydrocarbon fuel composition.

SUMMARY OF THE INVENTION

In accordance with certain aspects of the invention, it has been found that certain oxazoles and oxazolines are usefully employed as motor fuel additives. When employed at a concentration by weight in the range of from about 0.1 to about 20 percent these materials are about as effective in improving research octane number as methyl-tert-butyl ether, the commercial standard against which ashless antiknock agents have come to be judged.

In another aspect of the present invention there is provided a method for improving the antiknock properties of a motor fuel composition, especially a motor fuel which is predominantly hydrocarbon and boiling in the gasoline range. The method comprises incorporating into the motor fuel composition a sufficient amount of at least one of the additives selected from 1-oxa-3 azacylopent-2-ene, 3-ene, 4-ene, 2,4-diene and derivatives of these compounds to improve its antiknock properties. Representative members of this group of additives have been shown to be highly efficient at increasing the octane rating of gasoline compositions.

DETAILED DESCRIPTION OF THE INVENTION

The antiknock additives of the invention are highly suited for use in fuels in view of their ashless characteristics. Naturally, the various compounds of the herein disclosed group do not possess exactly identical effectiveness, and the most advantageous concentration for each such compound will depend to some extent upon the particular compound used. Also, the minimum effective inhibitor concentration can vary somewhat according to the specific nature of predominantly the hydrocarbon composition to which it is added.

The amounts of the antiknock agents of the invention added to the hydrocarbon fuels will generally be sufficient to improve the antiknock properties of the fuel. Usually these novel antiknock additives are employed in amounts from about 0.1 to about 20 percent (5,000 to 200,000 parts per million), usually from about 0.5 to about 10 percent (10,000 to 100,000 parts per million), preferably from about 1 to about 10 percent, (10,000 to 100,000 parts per million), by weight based on the total weight of the fuel composition, including additives.

The motor fuels or gasolines into which the invention additives are incorporated can be conventional motor fuel boiling in the range of 70°–420° F. (21.1°–216° C.). Gasolines or automotive fuels to which the described additives perform the functions described herein include substantially all grades of gasoline presently being employed in automotive and internal combustion aircraft engines. Generally automotive and aircraft gasolines contain both straight run and cracked stock with or without alkylated hydrocarbons, reformed hydrocarbons, and the like. Such gasolines can be prepared from saturated hydrocarbons, e.g., straight run stocks, alkylation products, and the like, with or without gum inhibitors, detergents, corrosion inhibitors, solvents, emulsifiers, and the like.

The antiknock additives of this invention are known chemical compositions and can be prepared by processes known to the art.

Generally speaking, the additives are certain oxazolines and oxazoles including derivatives, especially branched alkyl derivatives having less than 10 carbon atoms. Usually, the additives are selected from 1-oxa-3 azacylopent-2-ene, 3-ene, 4-ene, 2,4-diene and derivatives of these compounds. Generally speaking, a suitable additive can be selected from a material represented by one of the formulas

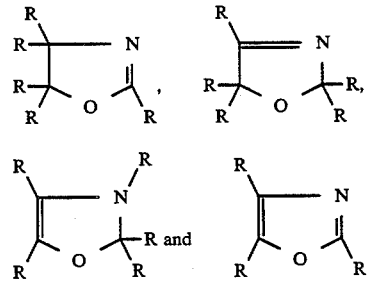

where R is H, hydrocarbyl containing 6 or fewer carbon atoms, or $-(CH_2)_nA$ where n is 0, 1 or 2 and A is the residue remaining after removing the R from one of the 5 membered rings shown. Preferably, R is H, $CH_3$, or branched alkyl containing 4 or fewer carbon atoms.

Oxazolines and mono, di- or trimethyl derivatives of oxazolines are the preferred additives. Preferred substituted additives include those having methyl substitution at the 2 and/or 4 position. Thus 2-methyl-2-oxazoline, 2-oxazoline, 3-methyl-2-oxazoline, 4-methyl-2-oxazoline, 2,3- or 2,4- or 3,4- or 3,3- or 4,4-dimethyl-2-oxazoline, 2,3,3- or 2,4,4- or 3,3,4- or 3,4,4-trimethyl-2-oxazoline are suitable. Additionally 3-oxazoline and alkyl derivatives thereof as well as 4-oxazoline and its alkyl derivatives are suitable additives. In addition to methyl substitution, secondary and tertiary alkyl and secondary alkenyl-substituted oxazolines are believed well suited. Thus, 3-isopropyl-2-methyloxazoline, 3-t-butyl- 2-methyloxazoline and 2-isopropenyl-4,4-dimethyl-2-oxazoline are suitable. Certain oxazoles and oxazole derivatives can be used, especially those which are substituted with methyl, isopropyl or tert-butyl groups at the 4 position. For example, 4-methyloxazole adds into gasoline with an extremely high octane value. Dimered oxazoline optionally with a dimethylene linkage are also believed suitable. Thus, 2,2'-dimethylene-bis(5-methyl-2-oxazoline) can be used.

The invention is illustrated by the following example.

EXAMPLE

Tests were carried out using varying amounts of 2-methyl 2-oxazoline in clear (unleaded) FT-266 gasoline. The following table presents the characteristics of FT-266 gasoline.

TABLE I

| CHARACTERISTICS OF FT 266 TEST GASOLINE | |
|---|---|
| Description: Unleaded premium pipeline base gasoline | |
| Designation | FT-266 |
| Reid Vapor Pressure, psi | 5.7 |
| API Gravity @ 60° F. | 60.3 |
| ASTM D-86 Distillation Vol % Evaporated | Temp. °F. |
| IBP | 102 |
| 5 | 142 |
| 10 | 164 |
| 15 | 178 |
| 20 | 190 |
| 30 | 210 |
| 40 | 224 |
| 50 | 235 |
| 60 | 247 |
| 70 | 264 |
| 80 | 292 |
| 90 | 335 |
| 95 | 373 |
| EP | 431 |
| Research Octane Number | 91.7 |
| Motor Octane Number | 84.1 |

The gasoline was engine tested to determine its Research Octane Number (RON) according to ASTM D 2599-47.

Table II represents the increase in Research Octane Number (RON) over the untreated fuel by the addition of the listed additive.

TABLE II

| Additive | Concentration | ΔRON |
|---|---|---|
| 2-methyl-2-oxazoline | 1.0 wt. % | 0.1 |
| | 2.0 wt. % | 0.7 |
| | 2.5 wt. % | 0.9 |
| 2-ethyl-2-oxazoline | 0.10 M (~1-2 vol. %) | 0.0 |
| 4-methyloxazole | 5 vol. % | 2.5 |
| 5-methylisoxazole | 0.1 M (~1-2 vol. %) | −0.7 |
| imidazole | 0.1 M (~1-2 vol. %) | −0.5 |
| 2-(O—hydroxyphenyl)-benzoxazole | 0.1 M (~1-2 vol. %) | −0.5 |
| 5,6-dihydro-2,4,4,6-tetra-methyl-4H—1,3-oxazine | 0.1 M | 0.0 |
| methyl-t-butylether | 1.0 wt. % | 0.0 |
| | 1.9 wt. % | 0.4 |
| | 2.4 wt. % | 0.4 |

The efficacy of the novel ashless antiknock compounds of the present invention for improving the antiknock properties of liquid hydrocarbon fuels will be apparent from the foregoing example and comparative data.

Some samples were tested at 5 wt. % and greater and showed a phase separation, and only the top phase was tested. All showed an improvement in RON.

I claim:

1. A gasoline composition containing an antiknock quantity of an additive selected from 1-oxa-3-azacyclopent-2-ene; 1-oxa-3-azacyclopent-3-ene; 1-oxa-3-azacyclopent-4-ene; 1-oxa-3-azacyclopent-2,4-diene and hydrocarbyl substituted derivatives of these compounds.

2. A gasoline composition containing from about 0.1 to about 20 percent by weight of an additive, wherein the additive is selected from 1-oxa-3-azacyclopent-2-ene; 1-oxa-3-azacyclopent-3-ene; 1-oxa-3-azacyclopent-4-ene; 1-oxa-3-azacyclopent-2,4-diene or a mono, di or trimethyl derivative thereof.

3. A gasoline composition as in claim 2 further characterized by the essential absence of lead compounds.

4. A gasoline composition containing an antiknock quantity of an additive selected from a material represented by one of the formulas

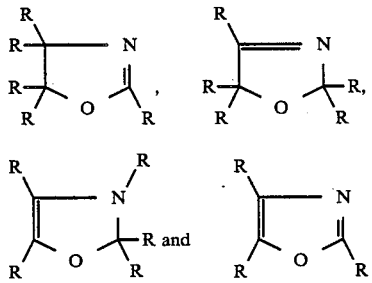

where R is H, hydrocarbyl containing 6 or fewer carbon atoms, or $(CH_2)_nA$ where n is 0, 1 or 2 and A is the ring residue remaining after removing an R from one of the above formulas.

5. A gasoline composition as in claim 4 which contains from about 1% to about 10% by weight of said additive, wherein R is H, $CH_3$, or branched alkyl containing 4 or fewer carbon atoms.

6. An unleaded gasoline composition containing from 1 to about 10 percent by weight of 2-methyl-1-oxa-3-azacyclopent-2-ene or 4-methyl-1-oxa-3-azacyclopent-2,4-diene.

7. A method for improving the antiknock properties of a gasoline composition, said method comprising incorporating into the gasoline composition a sufficient amount of an additive selected from 1-oxa-3-azacyclopent-2-ene; 1-oxa-3-azacyclopent-3-ene; 1-oxa-3-azacyclopent-4-ene; 1-oxa-3-azacyclopent-2,4-diene and hydrocarbyl substituted derivatives of these compounds to reduce the knocking tendencies of the gasoline composition and impart to the gasoline composition a concentration of said additive of at least 1 percent by weight of composition plus additive.

8. A method as in claim 7 wherein the derivative is formed by methyl substitutions at the 2 and/or 4 positions and the additive is present in an amount sufficient to impart to said composition a concentration of said additive in the range of from about 1 to about 10 percent by total weight of composition and additive.

9. A method as in claim 8 wherein the additive comprises 2-methyl-1-oxa-3-azacyclopent-2-ene or 4-methyl-1-oxa-3-azacyclopent-2,4-diene.

* * * * *